US010766012B2

(12) United States Patent
Carlson et al.

(10) Patent No.: US 10,766,012 B2
(45) Date of Patent: Sep. 8, 2020

(54) PAINT MIXING DEVICE AND METHOD

(71) Applicant: Radia, Plymouth, MN (US)

(72) Inventors: Stephen Carlson, Shorewood, MN (US); Thomas Midas, Oak Park Heights, MN (US)

(73) Assignee: RADIA, Plymouth, MN (US)

( * ) Notice: Subject to any disclaimer, the term of this patent is extended or adjusted under 35 U.S.C. 154(b) by 89 days.

(21) Appl. No.: 15/895,489

(22) Filed: Feb. 13, 2018

(65) Prior Publication Data

US 2018/0236420 A1 Aug. 23, 2018

Related U.S. Application Data

(60) Provisional application No. 62/461,901, filed on Feb. 22, 2017.

(51) Int. Cl.
*B01F 11/00* (2006.01)
*B01F 15/00* (2006.01)

(52) U.S. Cl.
CPC ..... *B01F 11/0008* (2013.01); *B01F 15/0074* (2013.01)

(58) Field of Classification Search
CPC ..... B01F 11/0008; B01F 15/0074
See application file for complete search history.

(56) References Cited

U.S. PATENT DOCUMENTS

| | | | | |
|---|---|---|---|---|
| 6,767,125 | B2 * | 7/2004 | Midas | B01F 9/0001 366/209 |
| 6,817,751 | B2 | 11/2004 | Huckby et al. | |
| 6,988,824 | B2 | 1/2006 | Santospago et al. | |
| 7,165,879 | B2 | 1/2007 | Midas et al. | |
| 2006/0109739 | A1 * | 5/2006 | Huckby | B01F 9/0001 366/208 |
| 2009/0040865 | A1 * | 2/2009 | Benjamin, II | B01F 11/0008 366/209 |

* cited by examiner

*Primary Examiner* — Anshu Bhatia
(74) *Attorney, Agent, or Firm* — Kagan Binder, PLLC

(57) ABSTRACT

A paint container holder for use in a paint mixer, the paint container holder capable of receiving a paint container with a square, tapered square or cylindrical shape.

20 Claims, 8 Drawing Sheets

PAINT MIXING DEVICE AND METHOD

CROSS-REFERENCE TO RELATED APPLICATIONS

This application claims the benefit of U.S. Provisional Patent Application No. 62/461,901, filed Feb. 22, 2017, the entire contents of which are incorporated herein by reference in its entirety.

BACKGROUND

The present invention relates to a system and method for mixing paint or colorants. More particularly, the present application is directed towards a system and method for mixing paint or colorants in, for example, cylindrical, rectangular, square and tapered square containers.

The present invention relates to apparatus and devices for mixing and agitating flowable material such as paint and the like in closed containers. More particularly, the present invention relates to paint container holders and the like which are capable of rapidly and efficiently mixing and agitating without requiring removal of the materials from their original containers and without requiring the containers to be cumbersomely clamped or otherwise inconveniently mechanically secured in place in the mixing or agitating apparatus.

Many flowable or fluidized materials such as paints, powdered materials, fungible particulates and the like, both in cans or other containers contain liquids of differing specific gravities as well as solids and/or powdered materials dispersed thereon. In many instances, the different constituents of the mixture require a thorough mixing and blending before the mixture is suitable for use in order to insure an even dispersion of the various constituents throughout the whole mixture. This is particularly important with paints, colorants, varnishes and other finishing agents wherein pigments are often solids and are usually much denser than some of the other liquid constituents. Oftentimes, after only a short time in a container on a ledge, the denser or heavier materials gravitate out from the lighter constituents and collect on the bottom of the can or container. Subsequently, when a can is opened, the material must be tediously mixed and agitated, often for extended periods of time before it is suitable for use. Even during the application process, the heavier materials in some mixtures may settle out and accordingly, periodic intermixing and agitation during use or application is required.

Recently such paint or colorants have become available in rectangular, square or tapered square-shaped containers, giving rise to the need for paint container holders to blend colors for paint in such containers that are not conventional cylindrical-shaped containers. To accommodate square or rectangular paint containers, a new holder can be provided in the paint mixer, suitable for receiving and retaining the conventional cylindrical container as well as the rectangular, square, or tapered square container.

SUMMARY

The present disclosure describes embodiments comprising a paint or colorant (paints, colorants and tints are collectively referred to as paint in this disclosure) container holder or a paint mixing holder device adapted for agitating and mixing flowable materials such as paint and the like in a container such as, for example, a cylindrical, square or tapered square container. The paint container holder or paint mixing holder device includes a base for supporting a container of paint that is mixed in conventional paint mixers.

BRIEF DESCRIPTION OF THE DRAWINGS

The present disclosure will be further described with reference to the appended Figures, wherein like structures are referred to by like numerals throughout the several views.

DETAILED DESCRIPTION

Figure 4:
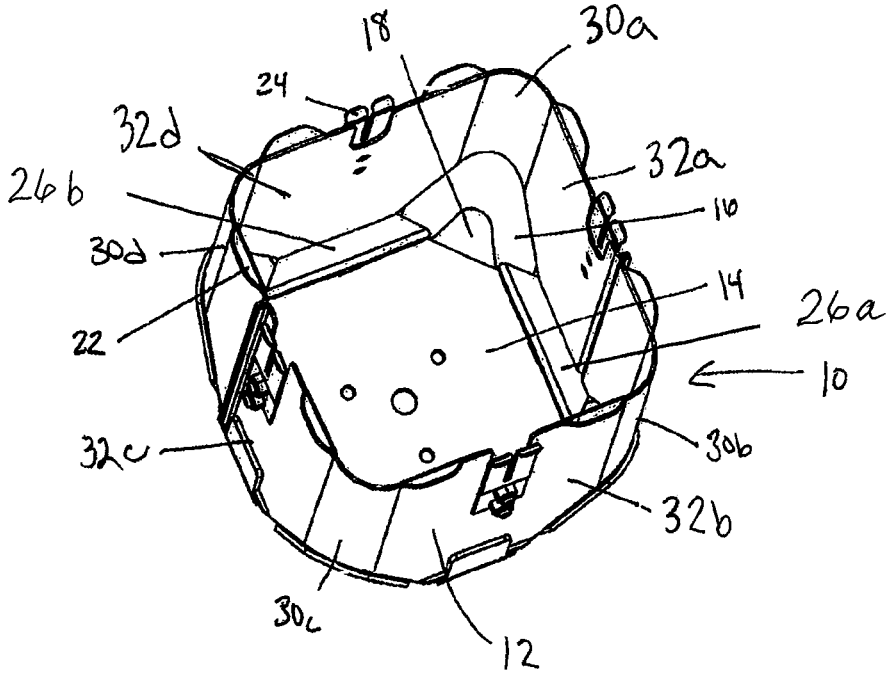
FIGS. 4-5 illustrate an example embodiment of a perspective top view showing an interior of a paint container holder as described and depicted herein.

Referring now more particularly to the drawings, therein is illustrated a new and improved paint container holder constructed in accordance with the features of the present invention and referred to generally by the reference numeral 10 in FIG. 4.

A paint container holder as described herein is adapted to receive a paint container, wherein the paint container may be generally square, cylindrical, or a tapered square container. The paint container holder comprises a generally square base portion comprising a tapered portion extending upright, upright sides extending from the tapered portion of the base, and openings at the tapered portion.

In an embodiment, the upright sides comprise at least one outwardly flaring flange. Alternatively, or in addition to, the uprights sides may comprise a tab comprising a slit, wherein the slit is adapted to receive a handle of the paint container. The tapered portion of the base or bottom as well as the flaring flange facilitate insertion of a paint can into the paint container holder using only the weight of the paint container without applying added force to insert the paint container or using only gravity to allow the paint container to freely slide into position in the holder.

In another embodiment, the base portion comprises a ledge extending from the base portion and upright sides.

In yet another embodiment, the upright sides meet to form a rounded corner.

Another disclosed embodiment is a paint container and a paint container holder or a paint mixing holder device as described herein that is adapted to receive a paint container, wherein the paint container holder may be a square, cylindrical, or tapered square container. The paint container holder comprises a generally square base portion comprising a tapered portion extending upright, upright sides extending from the tapered portion of the base, and opening at the tapered portion. The paint container is adapted to fit within the upright sides of the paint container holder.

Paint container holder 10 is configured to fit in standard paint mixers. Paint mixers (not shown) are used to mix paint within the paint container.

Figure 1:
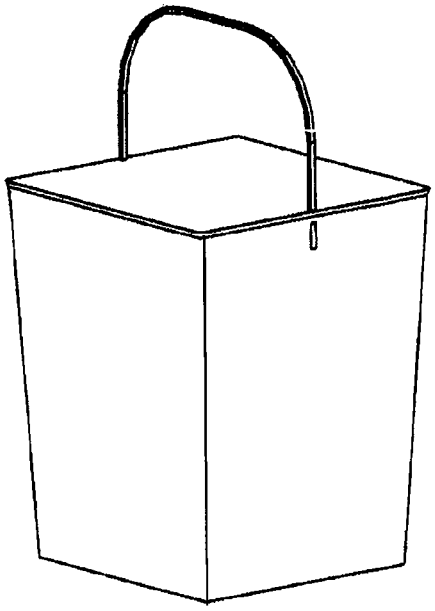
FIG. 1 illustrates a tapered square paint container.
Figure 2:
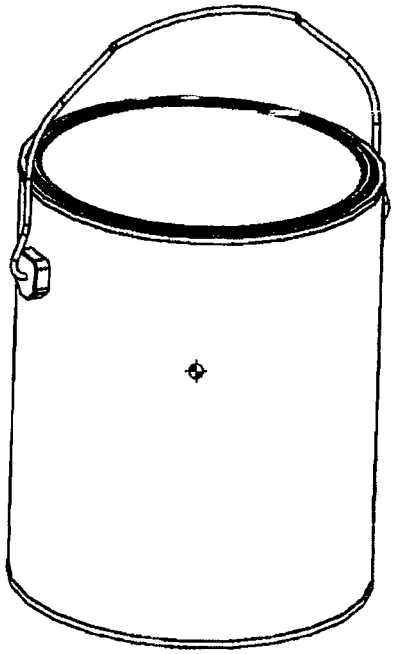
FIGS. 2-3 illustrate example embodiments of conventional cylindrical and square paint or colorant containers.
Figure 3:
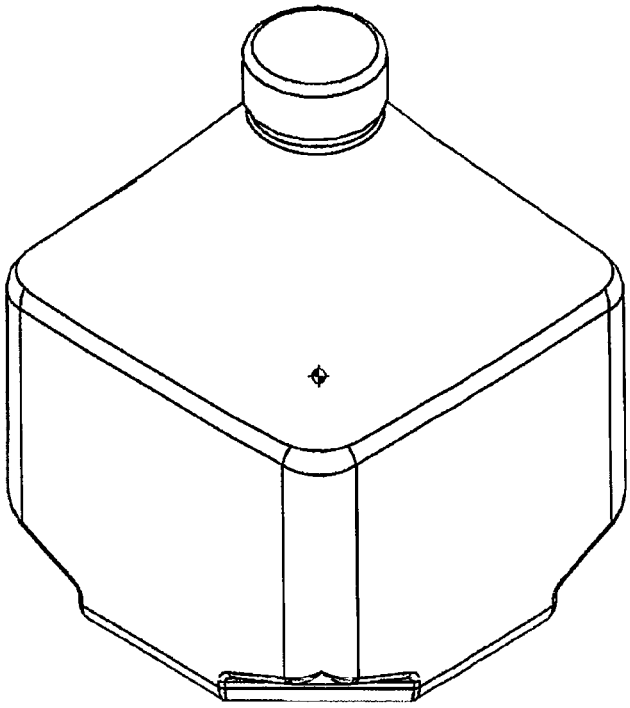

Paint container holder 10 is designed to hold square, cylindrical, and tapered square paint containers as illustrated in FIGS. 1-3. Further, paint mixing holder 10 is also capable of holding paint containers that have a handle. While paint container holder 10 is sized and shaped to hold conventional one gallon paint containers, a larger version of the paint container holder 10 may be capable of holding similarly shaped five gallon paint containers.

FIGS. 4-8 illustrate paint container holder 10 that comprises a generally square body 12. Body 12 has four sides 32*a*, 32*b*, 32*c*, and 32*d*, connected to base 14. Base 14 comprises a generally tapered bottom 16. Top 34 is open, which allows a user to insert and remove the paint container.

Each side 32*a*, 32*b*, 32*c*, and 32*d* comprises an upper edge 20 on an end opposite the base 14. Each upper edge 20 includes at least one flaring flange 22 that flares outward from the center of the paint container holder 10. Alternatively, each upper edge 20 includes two or more flaring flanges 22 that flare outward. Flaring flange 22 may extend from upper edge 20 at an angle of about 45°. Alternatively, angles smaller than 80° may be utilized. Flaring flange 22 may be at least 1 inch long and 0.25 inches tall. Alternatively, flange 22 may be up to 2 inches long and 1 inch tall. Flaring flanges 22 function to guide the paint container into paint container holder 10. Flaring flanges 22 may be made from a stiff material, such as metal, or a flexible material such as plastic or rubber. Flaring flange 22 facilitates insertion of a paint can into the paint container holder 10 using only the weight of the paint container without applying added force to insert the paint container.

A first side edge of side 32*a* is connected to a first side edge of side 32*b* at corner 30*a*, a second side edge of side 32*b* is connected to a first side edge of side 32*c* at corner 30*b*, a second side edge of side 32*c* is connected to a first side edge of side 32*d* at corner 30*c*, and a second side edge of side 32*d* is connected to a second side edge of side 32*a* at corner 30*d*. Sides 32*a*, 32*b*, 32*c*, and 32*d* form a generally square shape with an open interior. As shown in FIGS. 4-9, corners 30 may be rounded, or alternatively, sides 32 may come together at corner 30 to about a 90° angle (not shown).

Base 14 comprises a generally tapered bottom section 16. Alternatively, the sides 32*a*, 32*b*, 32*c*, and 32*d* and corners 30*a*, 30*b*, 30*c*, and 30*d* comprise a tapered section 16 as they extend toward the base 14. The tapered section 16 allows the tapered square paint container as shown in FIG. 1 to slide into the paint container holder using only the weight of the paint container without applying added force to insert the paint container or using only gravity to allow the paint container to freely slide into the interior of the paint container holder.

Figure 7:
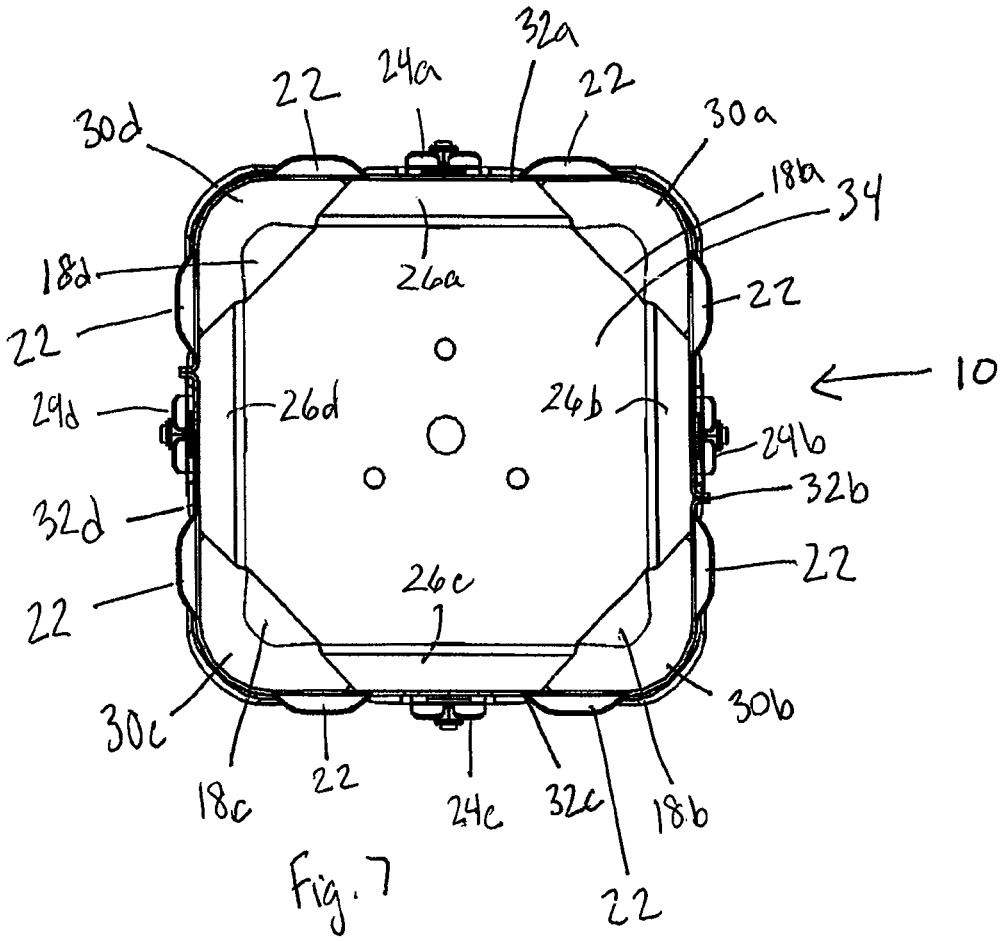
FIG. 7 illustrates an example embodiment of a top view of a paint container holder as described and depicted herein.

Each corner 30*a*, 30*b*, 30*c*, and 30*d* comprises an opening 18 at an edge near base 14. Openings 18*a*, 18*b*, 18*c*, and 18*d*, as shown in FIG. 7, are sized and shaped to accommodate a tapered square paint container within the interior of the paint container holder 10. For example, openings 18 may be triangular in shape.

Alternatively, openings 18 may be located at the tapered bottom 16 of the base 14. Opening 18 allows the corners of a rectangular paint container to extend outside of the interior of the paint container holder 10.

Paint container holder 10 may also comprise at least one ledge 26 illustrated, for example, in FIGS. 4 and 7 located on the base 14 and inner upright sides 32. Ledge 26*a* and 26*b* shown in FIG. 4 (ledges 26*c* and 26*d* not shown) enables a circular paint container to be at predetermined height in the paint container holder 10 and that is fitted in the paint container holder to prevent the container from being ejected from the paint container holder during the mixing process.

Figure 5:
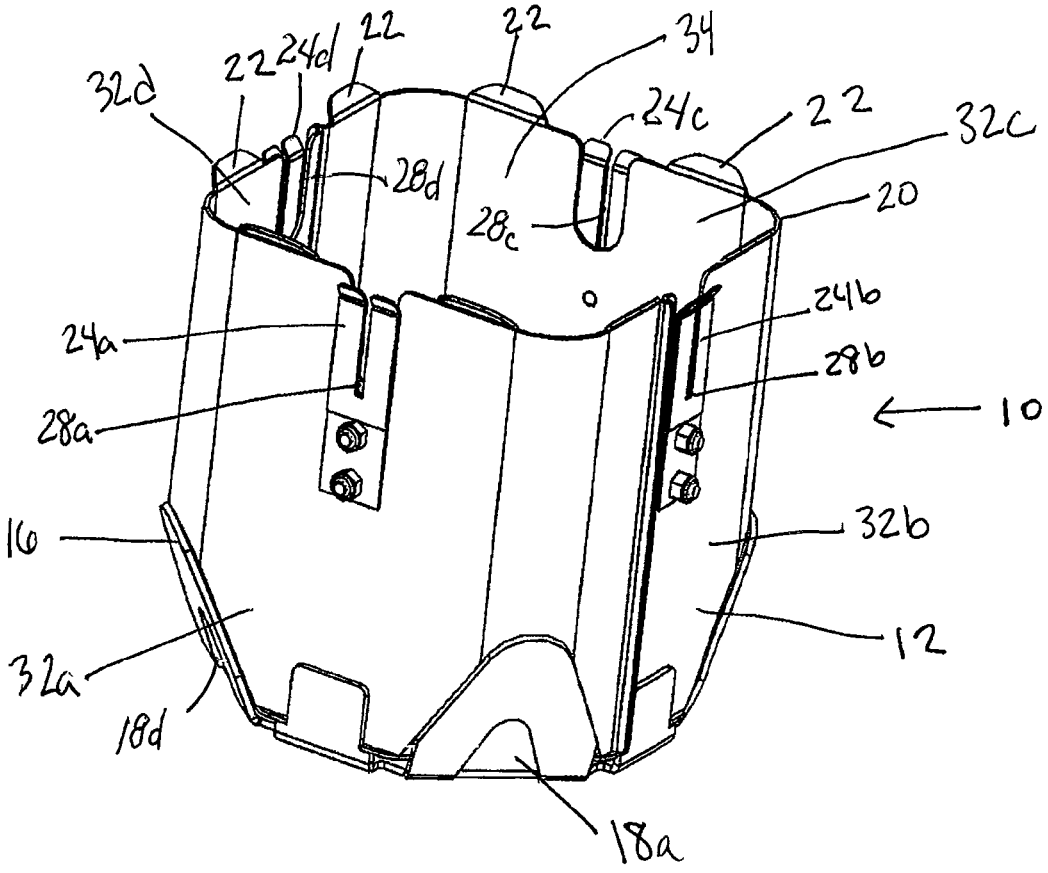
Figure 8:
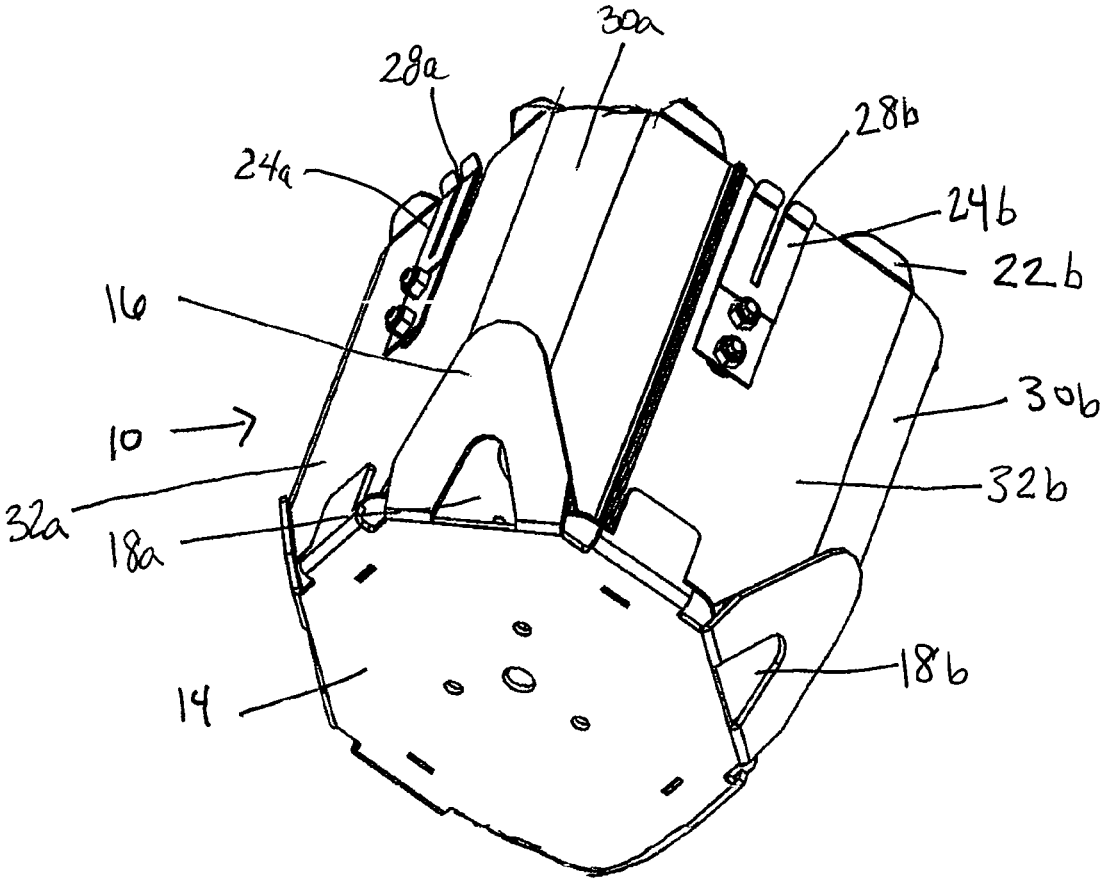
FIG. 8 illustrates an example embodiment of a perspective bottom view of a paint container holder as described and depicted herein.

As illustrated in FIGS. 5 and 8, for example, sides 32 may also comprise tabs 24 located on an end opposite the base 14. Tabs 24 comprise a slit 26 that is capable of receiving the handle of a paint container. Each side 32 may include one tab 24 located halfway between each end of the side 32. The four upright sides 32*a*, 32*b*, 32*c*, and 32*d* each comprise the four tabs 24*a*, 24*b*, 24*c*, and 24*d* that are located at 90° increments around the body 12 of the paint container holder 10. See also FIG. 8 as shown and described herein.

Figure 6:
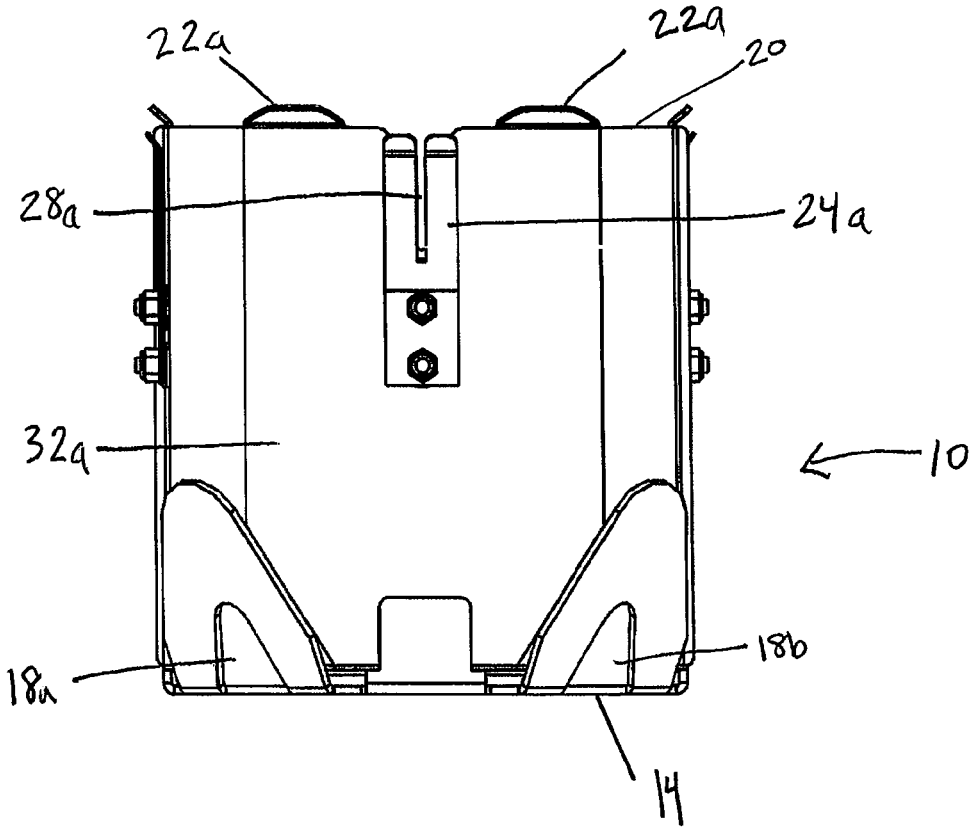
FIG. 6 illustrates an example embodiment of a side view of a paint container holder as described and depicted herein.

FIG. 6 illustrates a side view of paint container holder 10. The side view shows two of the openings, 18*a*, 18*b* located on side 32. Two flaring flanges 22 are located on a top of the upper edge 20 of the side 32. Slit 28 extends vertically in tab 24 on side 32.

FIG. 7 shows a top view of the paint container holder 10. As shown, all four openings 18*a*, 18*b*, 18*c*, 18*d* are located at corners 30*a*, 30*b*, 30*c*, and 30*d*, in between sides 32*a*, 32*b*, 32*c*, and 32*d*, as well as four ledges 26*a*, 26*b*, 26*c*, and 26*d*.

FIG. 8 illustrates a bottom view of paint container holder 10. Extending from base 14, are sides, 32*a* and 32*b* (32*c* and 32*d* not shown). Openings 18*a* and 18*b* are located at tapered bottom 16, in between sides 32*a*, 32*b* at corners 30*a* and 30*b*.

Figure 9:
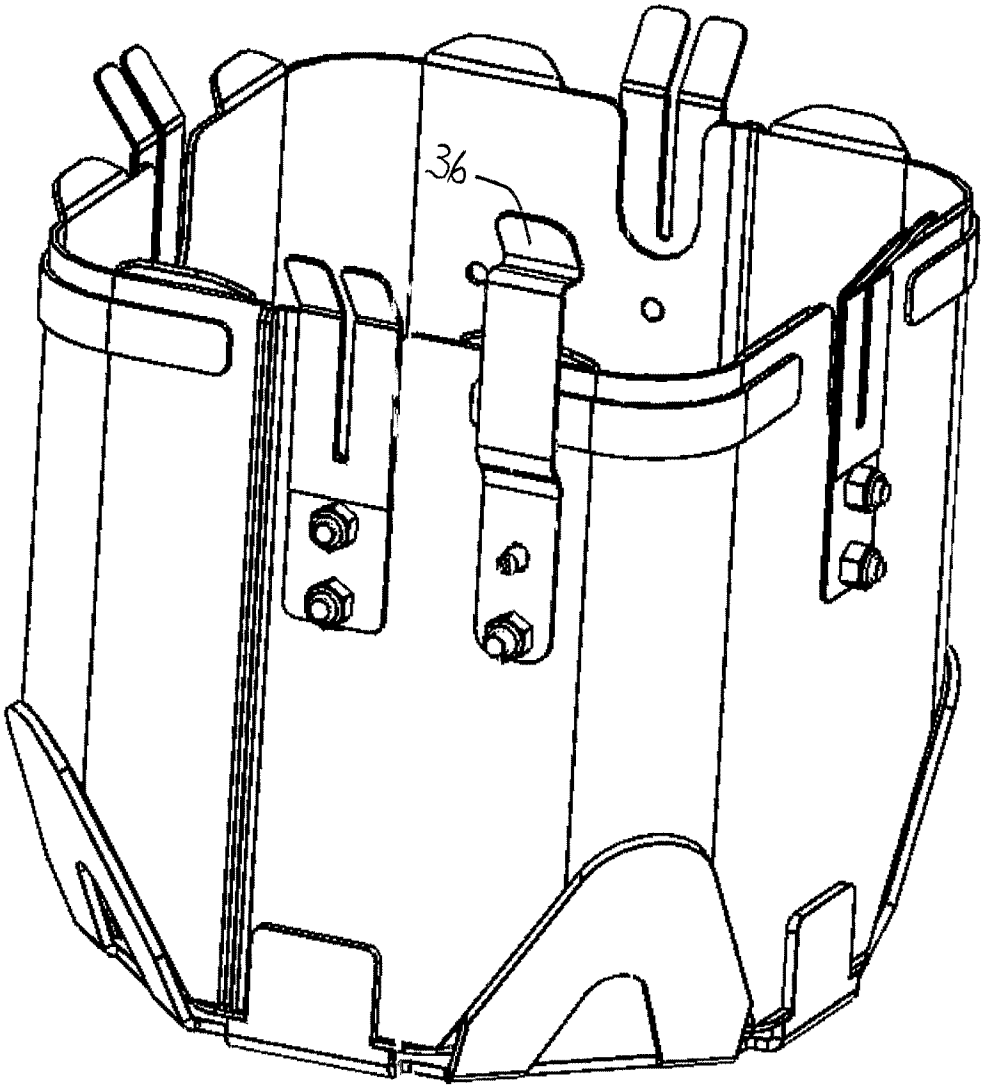
FIG. 9 illustrates an example embodiment of a perspective side view of a paint container holder having a safety clip as described and depicted herein.

FIG. 9 illustrates an embodiment of a paint container holder comprising a safety clip 36 attached to at least one of the upright sides 32. The safety clip serves to lock the paint container, for example a circular paint container, in the paint container holder during mixing.

Sides 32 may be formed from the same piece of material as base 14, or sides 32 may be secured to base 14 by any conventional means, such as welding. Alternative materials used to construct paint container holder 10 may be conventional materials such as metals or industrial polymers.

In use, a user inserts a paint container into paint container holder 10 through the top 34 into the interior of the holder. The paint container sits atop the base 14 (tapered square container), the ledge 26 (cylindrical container), or rests on the tapered bottom 16 (square container) while paint container holder 10 is fitted in a mixing device to mix the paint. If the paint container has a handle, the handle is placed through slits 28 in tabs 24. The paint container slides freely into the body 12 of paint container holder 10. The paint container holder 10 maintains the paint container in place while a paint mixer is shaking without ejecting the paint container. When it is desired to remove the paint container from the paint container holder 10, the user simply pulls the handle of the paint container to remove it.

Each differently shaped paint container is able to be placed and maintained within paint container holder 10 during mixing without causing excessive vibration. Ledge 26 supports a cylindrically shaped paint container so that it is held securely within paint container holder 10, while openings 18 and sides support a tapered square shaped painted container from vibrating within paint container holder 10. Further, ledge 26, openings 18, and upright sides 32 prevent the paint container from ejecting from paint container holder 10. In some embodiments safety clip 36 fits over the cover of the paint container serving to lock the paint container in the paint container holder.

The disclosed paint container holder is configured to be used with differently shaped containers. A square shaped paint container fits within the paint container holder 10 on top of the ledge 26 within the interior of the holder. A cylindrically shaped paint container also fits within the paint container holder 10 on top of the ledge 26. A paint container that has a tapered square shape comprises edges that extend through the openings 18 of the paint container holder 10. The safety clip 36 can be a redundant device.

U.S. Pat. Nos. 7,165,879 and 6,767,125 are hereby incorporated by reference in their entireties.

The present invention has now been described with reference to several embodiments thereof. The entire disclosure of any patent or patent application identified herein is hereby incorporated by reference. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the structures described herein, but only by the structures described by the language of the claims and the equivalents of those structures.

The invention claimed is:

1. A container holder for a paint mixer adapted to receive a paint or colorant container, the container holder comprising an open top portion to receive the paint or colorant container;

a generally square base portion having a tapered bottom section with a tapered portion at each corner of the base portion to support the paint or colorant container, wherein each tapered portion of the tapered bottom section has an opening therein, wherein the base portion has a plurality of edges, and wherein each edge of the base portion has a ledge located where the paint or colorant container contacts the base portion and the tapered bottom section when the paint or colorant container is received by the container holder; and a body comprising upright sides extending from and attached to the base portion and the tapered bottom section, wherein the upright sides are attached at adjacent edges of each upright side forming the body of the container holder.

2. The container holder of claim 1, wherein each of the upright sides comprise at least one outwardly flaring flange at the open top portion.

3. The container holder of claim 1, wherein the tapered bottom section facilitates insertion of the paint or colorant container into the container holder using only the weight of the paint or colorant container without applying added force to insert the paint or colorant container.

4. The container holder of claim 2, wherein the flaring flange facilitates insertion of the paint or colorant container into the container holder using only the weight of the paint or colorant container without applying added force to insert the paint or colorant container.

5. The container holder of claim 1, wherein each of the upright sides comprise a tab comprising a slit, wherein the slit is adapted to receive a handle of the paint or colorant container.

6. The container holder of claim 5, comprising four tabs, wherein each tab is located at 90° increments around the body.

7. The container holder of claim 1, wherein the ledge extends from the base portion and upright sides, enabling a circular paint or colorant container to be at a predetermined height when received by the container holder.

8. The container holder of claim 1, wherein at least one of the upright sides comprises a safety clip.

9. A mixing holder device and a paint or colorant container, the mixing holder device comprising an open top portion to receive the paint or colorant container;

a generally square base portion having a tapered bottom section with a tapered portion at each corner of the base portion to support the paint or colorant container, wherein each tapered portion of the tapered bottom section has an opening therein, wherein the base portion has a plurality of edges, and wherein each edge of the base portion has a ledge located where the paint or colorant container contacts the base portion and the tapered bottom section when the paint or colorant container is received by the container holder; and a body comprising upright sides extending from and attached to the base portion and the tapered bottom section, wherein the upright sides are attached at adjacent edges of each upright side forming the body of the mixing holder device, and wherein the paint or colorant container is adapted to fit within the upright sides of the mixing holder device.

10. The mixing holder device of claim 9, wherein each of the upright sides comprise at least one outwardly flaring flange at the top portion.

11. The mixing holder device of claim 9, wherein the tapered bottom section facilitates insertion of the paint or colorant container into the mixing holder device.

12. The mixing holder device of claim 10, wherein the flaring flange facilitates insertion of the paint or colorant container into the mixing holder device.

13. The mixing holder device of claim 9, wherein each of the upright sides comprise a tab comprising a slit, wherein the slit is adapted to receive a handle of the paint or colorant container.

14. The mixing holder device of claim 13, comprising four tabs, wherein each tab is located at 90° increments around the body.

15. The mixing holder device of claim 9, wherein the ledge extends from the base portion and upright sides, enabling a circular paint or colorant container to be at a predetermined height when received by the mixing holder device.

16. The mixing holder device of claim 9, wherein the paint or colorant container has a square, tapered square or cylindrical shape.

17. The mixing holder device of claim 9, wherein the paint or colorant container has a square shape and the paint or colorant container sits within the upright sides of the mixing holder device.

18. The mixing holder device of claim 15, wherein the paint or colorant container has a cylindrical shape and the paint or colorant container sits on top of the ledge.

19. The mixing holder device of claim 9, wherein the paint or colorant container has a tapered square shape and edges of the paint or colorant container extend from the openings of the upright sides of the mixing holder device.

20. The container holder of claim 1, wherein the paint or colorant container is a cylinder-shaped container, square-shaped container, or tapered square-shaped container having a center of gravity that is positioned in the container holder to minimize vibration and prevent ejection during mixing.

* * * * *